US007285965B2

(12) United States Patent
Shen et al.

(10) Patent No.: US 7,285,965 B2
(45) Date of Patent: Oct. 23, 2007

(54) PAPER-WIDTH DETECTING DEVICE

(75) Inventors: Feng-Chi Shen, Dounan Township, Yunlin County (TW); Hui-Kung Sun, Jhubei (TW)

(73) Assignee: Avison Inc (TW)

( * ) Notice: Subject to any disclaimer, the term of this patent is extended or adjusted under 35 U.S.C. 154(b) by 308 days.

(21) Appl. No.: 11/051,448

(22) Filed: Feb. 4, 2005

(65) Prior Publication Data

US 2005/0174413 A1 Aug. 11, 2005

(30) Foreign Application Priority Data

Feb. 5, 2004 (TW) ..... 93102690 A

(51) Int. Cl.
*B65H 1/00* (2006.01)
*B41J 29/38* (2006.01)

(52) U.S. Cl. ..... 324/716; 399/370

(58) Field of Classification Search ..... None
See application file for complete search history.

(56) References Cited

U.S. PATENT DOCUMENTS 5,940,106 A * 8/1999 Walker ..... 347/104

FOREIGN PATENT DOCUMENTS

JP 03045374 A * 2/1991
JP 04039218 A * 2/1992
JP 05043060 A * 2/1993
JP 06227678 A * 8/1994
JP 10171308 A * 6/1998

* cited by examiner

*Primary Examiner*—Daniel J. Colilla

(57) ABSTRACT

A paper-width detecting device includes a paper guide, a conductive element, a circuit board and a control-processing unit. The paper guide is movably disposed on a paper tray for accommodating different sizes of papers. The conductive element attaching to the paper guide and moving simultaneously with the paper guide has a plurality of first conductive portions. The circuit board has a plurality of conductive wires, which is formed by a plurality of separated second conductive portions on the surface of the circuit board. An insulating region is formed between any two adjacent second conductive portions of each conductive wire. The control-processing unit is for providing an electric voltage between the conductive wires and the conductive element. When the paper guide presses against the paper, the control-processing unit generate a paper-width value corresponding to the number of current passages formed between the first conductive portions and the corresponding conductive wire thereof.

10 Claims, 8 Drawing Sheets

PAPER-WIDTH DETECTING DEVICE

This application claims the benefit of Taiwan application Ser. No. 93102690, filed Feb. 5, 2004, the subject matter of which is incorporated herein by reference.

BACKGROUND OF THE INVENTION

1. Field of the Invention

The invention relates in general to a paper-width detecting device of a document feeder, and more particularly to a paper-width detecting device having the function for detecting the width of non-standard paper.

2. Description of the Related Art

Referring to FIG. 1, a partial top view of a conventional automatic document feeder is shown. In FIG. 1, an automatic document feeder 10 includes a paper tray 12, a paper guide 13 and sensing elements 14*a*, 14*b* and 14*c*, wherein the paper guide 13 is fixed on the paper tray 12 for accommodating papers 15*a*, 15*b* and 15*c*. The sensing elements 14*a* to 14*b* are separately disposed on the paper tray 12 for correspondingly detecting the width of the papers 15*a* to 15*c*. When the paper 15*a* covers up the sensing element 14*a*, the sensing element 14*a* detects the paper 15*a*, and the automatic document feeder 10 will preset the width of the paper 15*a* as A5 width. Besides, when the paper 15*b* covers up the sensing elements 14*a* and 14*b* but not the sensing element 14*c*, the width of the paper 15*b* is preset as A4 width. When the paper 15*c* covers up the sensing elements 14*a* to 14*c*, the width of the paper 15*b* is preset as B4 width, in accordance with the positions of the sensors 14*a* to 14*c* covered up by the paper 15*c*.

It is noteworthy that the conventional design of using a plurality of sensing elements to detect paper width can be applied to standard paper sizes such as A5, A4 and B4 only, and cannot detect the width of non-standard paper. Moreover, if more types of paper width are to be detected, more sensing elements and more complicated paper-width determining mechanism need to be disposed in the automatic document feeder. Consequently, additional costs will be incurred.

SUMMARY OF THE INVENTION

It is therefore an object of the invention to provide a paper-width detecting device, which can detect the width of non-standard paper size so as to transcend the limitation of a conventional design which can only detect the width of standard paper size.

The invention achieves the above-identified object by providing a paper-width detecting device disposed in a paper tray. The paper-width detecting device includes at least a paper guide, a conductive element, a circuit board and a control-processing unit. The paper guide is movably disposed on the paper tray for accommodating different sizes of papers loaded in the paper tray. The conductive element is attached to the paper guide and moves simultaneously with the paper guide. The conductive element has a plurality of first conductive portions. The circuit board has a plurality of parallel conductive wires extending in a direction parallel to the moving direction of the conductive element and being formed by a plurality of separated second conductive portions on the surface of the circuit board. An insulating region is formed between any two adjacent second conductive portions of each conductive wire. The first conductive portions correspondingly contact the second conductive portions and the insulating regions of each conductive wire as the paper guide moves. The control-processing unit is for providing an electric voltage between the conductive wires and the conductive element, such that the first conductive portions electrically contact the second conductive portions and the insulating regions of each conductive wire. When the paper guide presses against the paper, the control-processing unit obtains a digital signal corresponding to the number of current passages formed between the first conductive portions and the corresponding conductive wire thereof so as to generate a paper-width value accordingly.

According to another object of the invention, a paper-width detecting device disposed in a paper tray is provided. The paper-width detecting device includes at least a paper guide, a conductive element, a circuit board and a control-processing unit. The paper guide is movably disposed on paper tray for accommodating different sizes of papers loaded in the paper tray. The conductive element is attached to the paper guide and moves simultaneously with the paper guide. The conductive element has a conductive portion. The circuit board has a conductive wire disposed thereon. The conductive wire, formed by a series of resistors, extends in a direction parallel to the moving direction of the conductive element and contacts the conductive portion. The control-processing unit is for providing an electric voltage between the conductive wire and the conductive portion, such that the conductive portion electrically contacts the conductive wire. When the paper guide presses against the paper, the control-processing unit generates a paper-width value according to a current volume which the control-processing unit detects.

Other objects, features, and advantages of the invention will become apparent from the following detailed description of the preferred but non-limiting embodiments. The following description is made with reference to the accompanying drawings.

DETAILED DESCRIPTION OF THE INVENTION

Preferred Embodiment One

Figure 1:
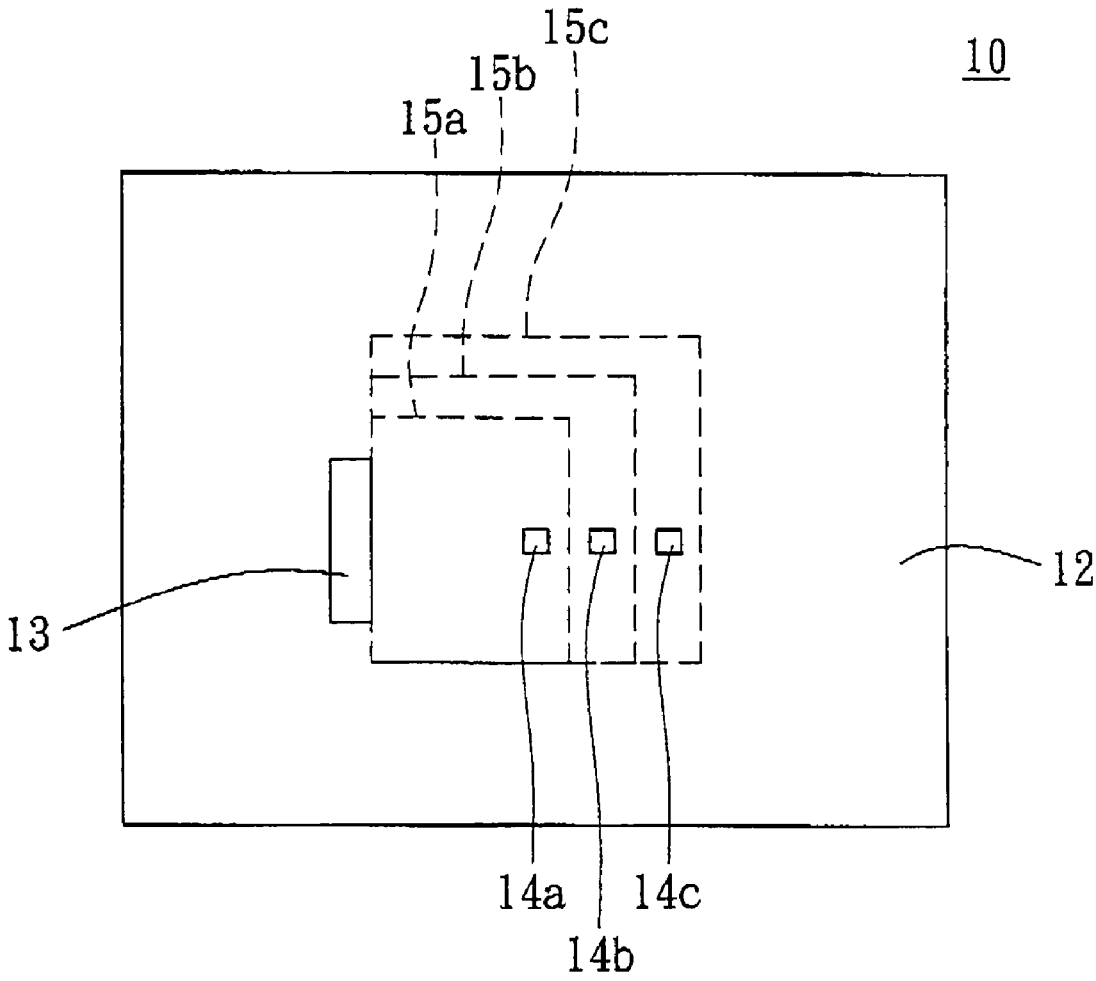
FIG. 1(PRIOR ART)
FIG. 1 (Prior Art) is a partial top view of a conventional automatic document feeder.
Figure 2A:
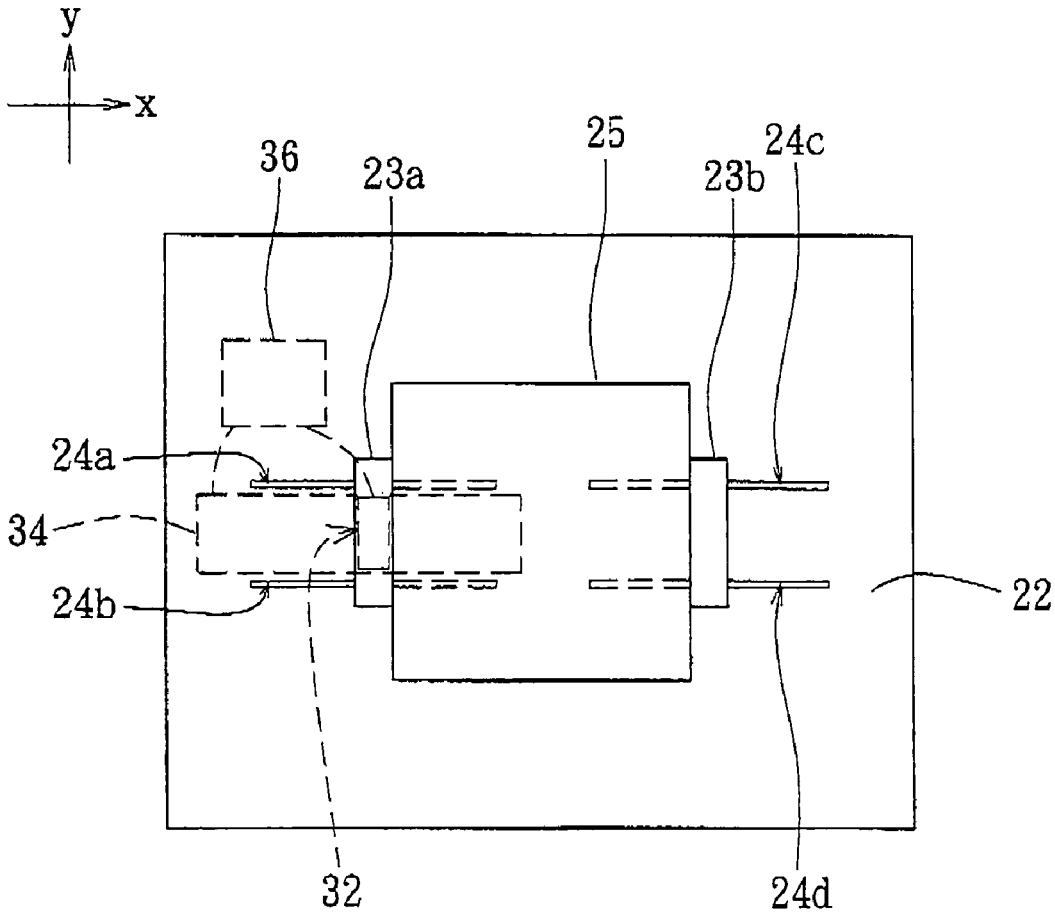
FIG. 2A is a partial top view of the paper-width detecting device and the paper tray according to preferred embodiment one of the invention.
Figure 2B:
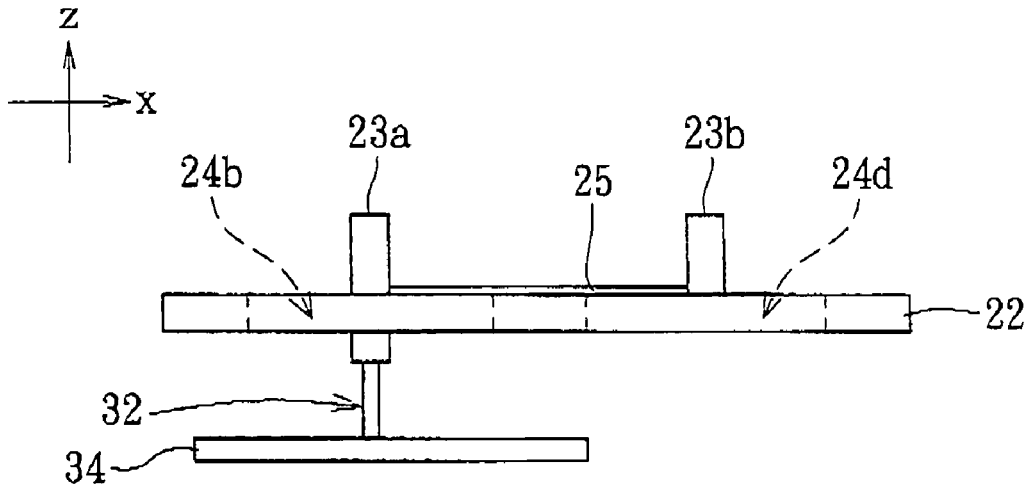
FIG. 2B is a partial side view of the paper-width detecting device and the paper tray in FIG. 2A.
Figure 2C:
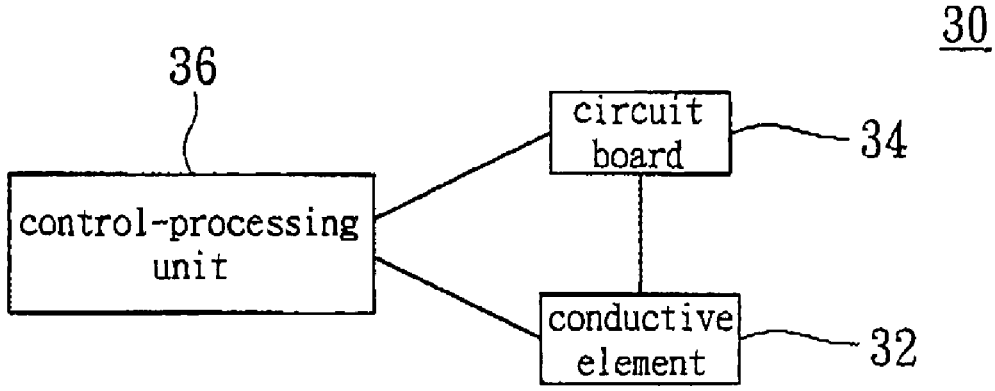
FIG. 2C is a circuit diagram of the paper-width detecting device in FIG. 2A.

Please refer to FIGS. 2A to 2C together. FIG. 2A is a partial top view of the paper-width detecting device and the paper tray according to preferred embodiment one of the invention; FIG. 2B is a partial side view of the paper-width detecting device and the paper tray in FIG. 2A; and FIG. 2C is a circuit diagram of the paper-width detecting device in FIG. 2A. In FIGS. 2A to 2C, a paper-width detecting device 30 is disposed on a paper tray 22, wherein the paper tray 22 is disposed on a document feeder, an automatic document feeder (ADF) for instance. The paper tray 22 has at least a sliding slit, for example, sliding slits 24*a* to 24*d*. The paper-width detecting device 30 includes at least a paper guide, a conductive element 32 attaching to the paper guide, a circuit board 34 and a control-processing unit 36. The paper guide is movably disposed on the paper tray 22 and is for accommodating different sizes of papers loaded in the paper tray 22. For example, the paper guides 23*a* and 23*b* can slide respectively on sliding slits 24*a* and 24*b* and sliding slits 24*c* and 24*d*. The paper guides 23*a* and 23*b* can simultaneously move towards or away from each other along the direction of the x-axis until the paper guides 23*a* and 23*b* press against a paper 25. The present preferred embodiment is demonstrated by dual paper guides, and the paper is aligned to the center. In practical applications, when a single-paper-guide document feeder is used, the paper is aligned to a sidewall of the paper tray.

Figure 2D:
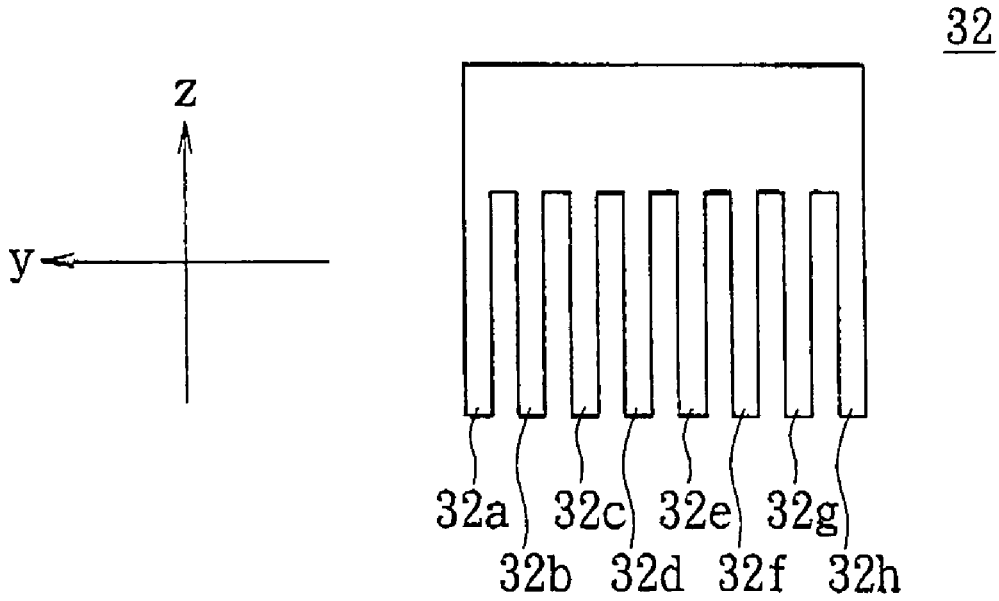
FIG. 2D is a side view of the conductive element in FIG. 2A.

As shown in FIG. 2B, the conductive element 32 is attached to the paper guide and moves simultaneously with the paper guide. The conductive element 32 can be disposed underneath either of the paper guides 23*a* and 23*b*. Here, as an example, the conductive element 32 is disposed underneath the paper guide 23*a*. The conductive element 32 and the paper guide 23*a* simultaneously move back and forth on the circuit board 34 along the direction of the x-axis. As shown in FIG. 2D, the conductive element 32 has a plurality of first conductive portions with equal distance separating them, for example, eight first conductive portions 32*a* to 32*h*, wherein the eight first conductive portion 32*a* to 32*h* are aligned to the direction of the y-axis, which is exactly perpendicular to the moving direction of the conductive element 32. As shown in FIG. 2C, the control-processing unit 36 is electrically connected to the conductive element 32 and the circuit board 34. The control-processing unit 36 is for providing an electric voltage between the circuit board 34 and the conductive element 32.

Figure 2E:
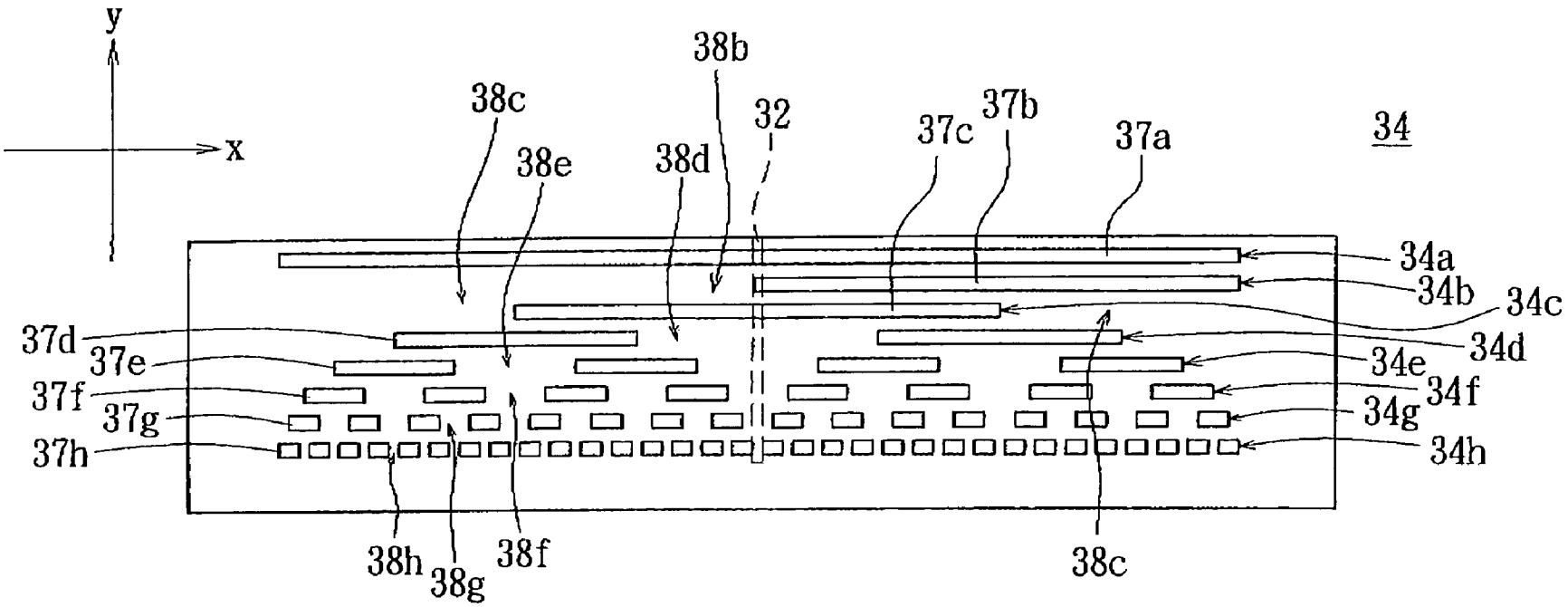
FIG. 2E is a top view of the circuit board in FIG. 2A.

As shown in FIG. 2E, the circuit board 34 has a plurality of conductive wires in parallel to each other, for example, conductive wires 34*a* to 34*h*. The conductive wires 34*a* to 34*h* extend in a direction, such as x-axis, parallel to the moving direction of the conductive element 32. Each of the conductive wires 34*a* to 34*h* is formed by a plurality of second conductive portions on the surface of the circuit board 34. An insulating region is formed between any two adjacent second conductive portions of each conductive wire. For example, the conductive wires 34*a* to 34*c* are respectively formed by second conductive portions 37*a* to 37*c* on the surface of the circuit board 34, while the conductive wires 34*d* to 34*h* are respectively formed by the second conductive portions 37*d* to 37*h* on the surface of the circuit board 34. The second conductive portion 37*a* has the longest length, the second conductive portions 37*b* to 37*c* have the second longest length, and the lengths of the second conductive portions 37*d* to 37*h* decrease accordingly. An insulating region 38*b* is formed to the left end of the conductive portion 37*b*, while an insulating region 38*c* is formed to the both ends of the conductive portion 37*c*. An insulating region 38*d* is formed between any two adjacent second conductive portions 37*d*. An insulating region 38*e* is formed between any two adjacent second conductive portions 37*e*. An insulating region 38*f* is formed between any two adjacent second conductive portions 37*f*. An insulating region 38*g* is formed between any two adjacent second conductive portions 37*g*. An insulating region 38*h* is formed between any two adjacent second conductive portions 37*h*. The first conductive portion 32*a* contacts the second conductive portion 37*a*. The first conductive portions 32*b*~32*h* contact the second conductive portions 37*b*~37*h* or the insulating regions 38*b*~38*h*.

The control-processing unit 36 provides an electric voltage between the conductive wires 34*a* to 34*h* and the conductive element 32, such that the first conductive portions electrically contact the second conductive portions and the insulating regions of each conductive wire. When the paper guides 23*a* and 23*b* press against the paper 25 in FIG. 2A, the first conduction portion 32*a* electrically contacts the second conduction portion 37*a*, the first conduction portions 32*b* to 32*h* electrically contact the second conductive portions 37*b* to 37*h* or the insulating regions 38*b* to 38*h* correspondingly. The control-processing unit 36 obtains a digital signal corresponding to the number of current passages formed between the first conductive portions 32*a* to 32*h* and the corresponding conductive wire 34*a* to 34*h* so as to generate a paper-width value accordingly.

Figure 2F:
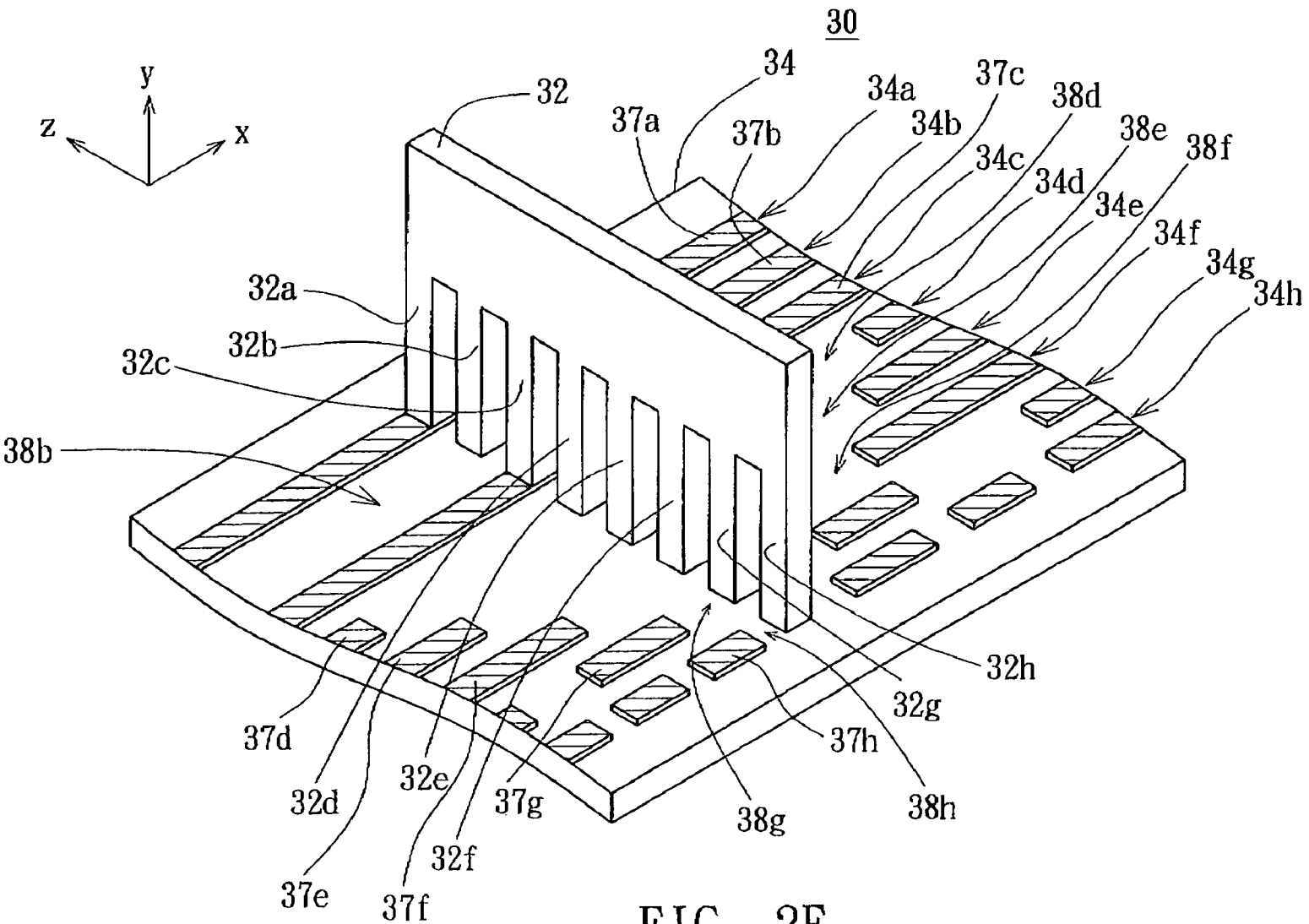
FIG. 2F is a partial three-dimensional diagram of the circuit board and conductive element in FIG. 2E.

For example, the control-processing unit 36 detects the current flow between each of the first conductive portions 32*a* to 32*h* and each of the corresponding conductive wire 34*a* to 34*h* to determine the paper width of the paper loaded in the paper tray. As shown in FIG. 2F, the first conductive portions 32*a* to 32*c* electrically contact the second conductive portions 37*a* to 37*c* correspondingly, while the first conductive portions 32*d* to 32*h* correspond to the insulating regions 38*d* to 38*h* respectively. Meanwhile, the first conductive portions 32*a* to 32*c* will have a current to flow through, but the first conductive portions 32*d* to 32*h* will not. As a result, three current passages are formed between the conductive element 32 and the conductive wires 34*a* to 34*h*. The control-processing unit 36 defines the value of the digital signal as "1" when a current flow through any one of the first conductive portions 32*a* to 32*h* and define the value of the digital signal as "0" when no current flow through any one of the first conductive portions 32*a* to 32*h*. Take FIG. 2F for example, given that a current flow through the first conductive portions 32*a* to 32*c*, the digital signal obtained by the control-processing unit 36 is represented as "11100000".

It is noteworthy that each digital signal is a set of binary codes and that the number of bits of the digital signal is less or equal to the number of the first conductive portions of the conductive element 32. Besides, the second conductive portions 37*a* to 37*h* and the insulating regions 38*b* to 38*h* of the conductive wire 34*a* to 34*h* are arranged on the circuit board 34 according to the coding rules of gray codes, such that only one bit of the digital signal is different for any two adjacent paper-width values. Therefore, when the conductive element 32 is at different positions on the circuit board 34, different digital signals will be generated without repetition. Each digital signal corresponds to a paper-width value. The control-processing unit 36 pre-stores a database whereby the control-processing unit 36 can generate the paper-width value after having calculated the digital signal. In other word, the control-processing unit 36 comprises the database for providing a reference data corresponding to the value of the digital signal in order to generate the paper-width value. Thus, the invention can detect the width of sheets of non-standard paper sizes, other than standard paper sizes such as A4 or A5, transcending the limitation of a conventional design which uses sensing elements and detects the width of sheets of standard paper sizes only.

However, anyone who is familiar with above technology will realize that the technology of the invention is not limited thereto. For example, the first conductive portions 32*a* to 32*h* and the second conductive portions 37*a* to 37*h* can be metals or metallic alloys; the circuit board 34 can be a printed circuit board (PCB); the control-processing unit 36 can be a microprocessor or an application specific integrated circuit (ASIC). Besides, the control-processing unit 36 is disposed on the circuit board 34. The paper-width detecting device 30 of the invention can be disposed on a scanner, a printer, a copier, a facsimile machine or a multi-functional peripheral, so that the paper-width value generated by the control-processing unit 36 can serve as a reference information for the abovementioned machine when selecting paper size.

Preferred Embodiment Two

Figure 3A:
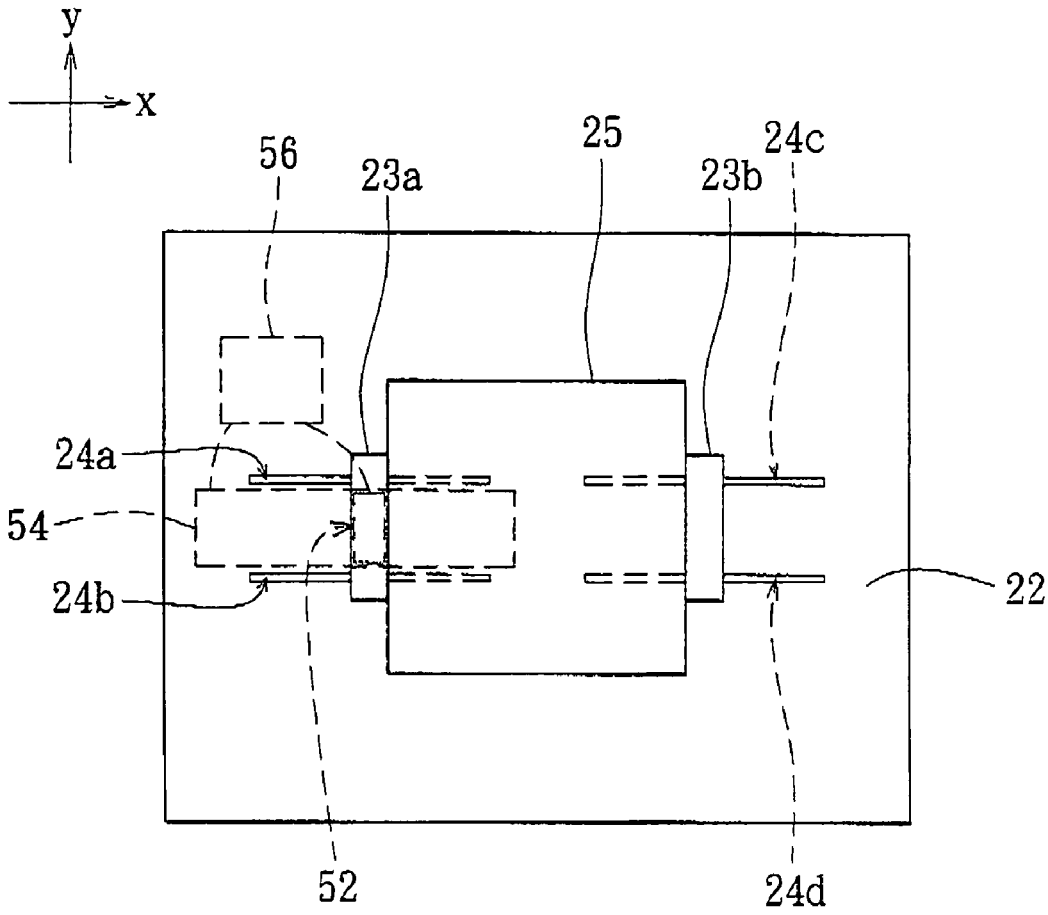
FIG. 3A is a partial top view of the paper-width detecting device and the paper tray according to preferred embodiment two of the invention.
Figure 3B:
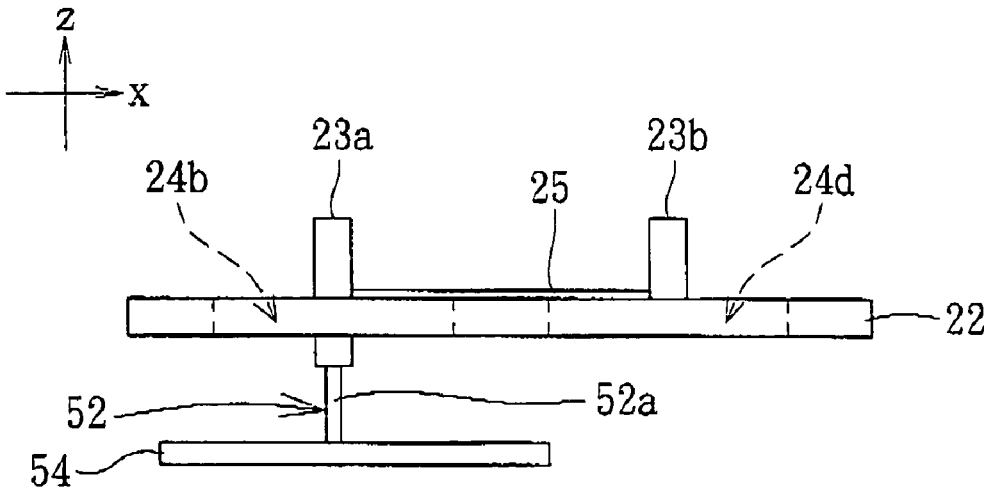
FIG. 3B is a partial side view of the paper-width detecting device and the paper tray in FIG. 3A.
Figure 3C:
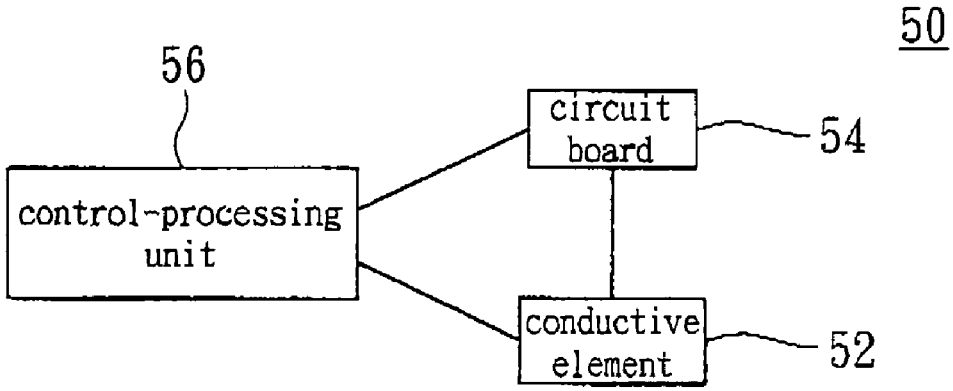
FIG. 3C is a circuit diagram of the paper-width detecting device in FIG. 3A.

Please refer to FIGS. 3A to 3C together. FIG. 3A is a partial top view of the paper-width detecting device and the paper tray according to preferred embodiment two of the invention; FIG. 3B is a partial side view of the paper-width detecting device and the paper tray in FIG. 3A; and FIG. 3C is a circuit diagram of the paper-width detecting device in FIG. 3A. The present preferred embodiment differs with preferred embodiment one in paper-width detecting device 50. As for other similar elements, the same numbering system is used in the embodiment two.

The paper-width detecting device 50 includes a conductive element 52, a circuit board 54, a control-processing unit 56 and at least a paper guide such as paper guides 23*a* and 23*b* for instance. The paper guides 23*a* and 23*b* are disposed on the paper tray 22 and move simultaneously in opposite directions. As shown in FIG. 3B, the conductive element 52 is attached to one of the paper guides and moves simultaneously with the paper guide. For example, the conductive element 52 is disposed underneath the paper guide 23*a*. The conductive element 52 and the paper guide 23*a* simultaneously move back and forth on the circuit board 54 along the direction of the x-axis. The conductive element 52 has a conductive portion 52*a*. As shown in FIG. 3C, the control-processing unit 56 electrically connects to the conductive element 52 and the circuit board 54. The control-processing unit 56 is for providing an electric voltage between the circuit board 54 and the conductive element 52.

Figure 3D:
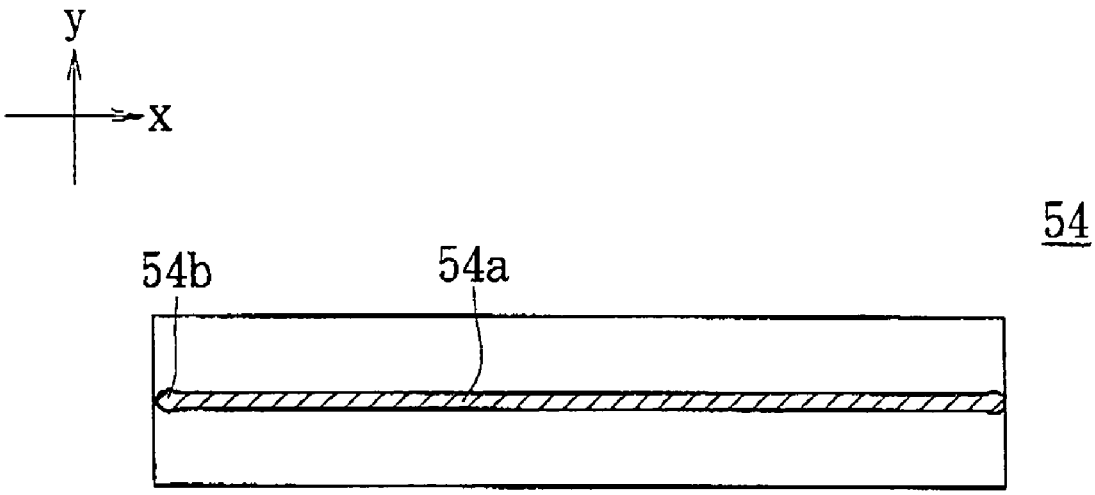
FIG. 3D is a top view of the circuit board in FIG. 3A.

As shown in FIG. 3D, the circuit board 54 has a conductive wire 54*a* disposed thereon. The conductive wire 54*a*, formed by a series of resistors, extends in a direction parallel to the moving direction of the conductive element 52 and contacts the conductive portion 52*a*. The control-processing unit 56 is for providing an electric voltage between the conductive wire 54*a* and the conductive portion 52*a*, such that the conductive portion 52*a* electrically contacts the conductive wire 54*a*. The conductive wire 54*a* has a power receiving terminal 54*b* being coupled with the control-processing unit 56. When the conductive portion 52*a* electrically contacts with the conductive wire 54*a* at a contact point, the conductive portion 52*a* will have a current flowing through, wherein the current is related to the resistance along the length of the conductive wire 54*a* from the power receiving terminal 54*b* to the contact point. When the contact point gets farther away from the power receiving terminal 54*b*, the value of the resistance between the power receiving terminal 54*b* and the contact point will become larger, where the current passes through the conductive element 52 will become smaller. Therefore, the current flowing through the conductive element 52 is inversely proportional to the distance between the contact point and the power contact terminal 54*b*.

Figure 3E:
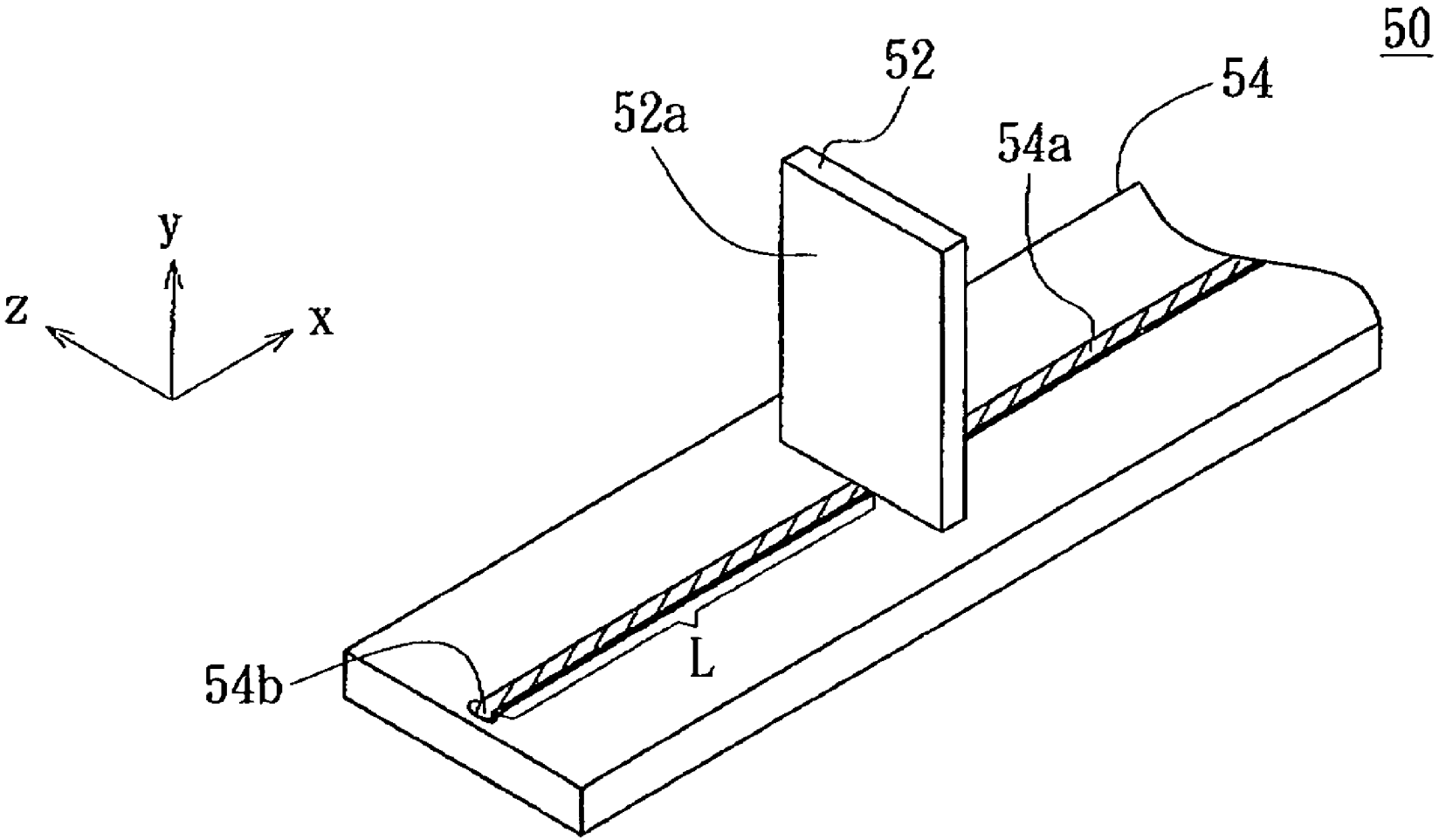
FIG. 3E is a partial three-dimensional diagram of the circuit board and conductive element in FIG. 3D.

When the paper guides 23*a* and 23*b* press against the paper 25 in FIG. 3A, the conductive portion 52*a* electrically contacts the conductive wire 54*a* at a contact point, the length of the conductive wire 54*a* from the contact point to the power receiving terminal 54*b* is L as shown in FIG. 3E. When the width of the paper 25 becomes longer, the value of L will become greater accordingly and more resistors are retained in between. This means, the current flowing through the conductive element 52 and detected by the control-processing unit 56 gets smaller as the width of the paper gets longer. The current flowing through the conductive element 52 varies with the distance between the power receiving terminal 54*b* and the contact point on the conductive wire 54*a*. The control-processing unit 56 generates a paper-width value according to the current which the control-processing unit 65 detects. The control-processing unit 56 can pre-store a database whereby a paper-width value representing the width of the paper loaded is generated according to the current detected by the control-processing unit 56. In other word, the control-processing unit 56 comprises the database for providing a reference data corresponding to the value of the current in order to generate the paper-width value. The paper-width detecting device of the invention can detect the width of sheets of non-standard paper size so as to transcend the conventional design which uses a sensing element to detect the paper width and is restricted to standard paper sizes such as A4 or A5 only.

However, anyone who is familiar with above technology will realize that the technology of the invention is not limited thereto. For example, the conductive portion 52*a* and conductive wire 54*a* can be metals or metallic alloys; the circuit board 54 can be a printed circuit board (PCB); the control-processing unit 56 can be a microprocessor or an application specific integrated circuit (ASIC). Besides, the control-processing unit 56 is disposed on circuit board 54. When the power receiving terminal 54*b* of the conductive wire 54*a* is disposed between the paper guides 23*a* and 23*b*, the smaller the volume of current flowing through the conductive element 52 is detected, the smaller the paper-width value is implied. Moreover, the control-processing unit 56 can further define the corresponding relationship between a current range and a paper-width value using another database.

The paper-width detecting device disclosed in the above preferred embodiments of the invention can detect the paper width of non-standard size, transcending the limitation of a conventional design which can detect the paper width of standard size only.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A paper-width detecting device disposed in a paper tray comprising:

at least a paper guide movably disposed on the paper tray for accommodating different sizes of papers loaded in the paper tray;

a conductive element attaching to the paper guide and moving simultaneously with the paper guide, wherein the conductive element has a plurality of first conductive portions;

a circuit board having a plurality of parallel conductive wires, extending in a direction parallel to the moving direction of the conductive element and being formed by a plurality of separated second conductive portions on the surface of the circuit board, wherein an insulating region is formed between any two adjacent second conductive portions of each conductive wire and the first conductive portions correspondingly contact the second conductive portions and the insulating regions of each conductive wire as the paper guide moves; and a control-processing unit for providing an electric voltage between the conductive wires and the conductive element, such that the first conductive portions electrically contact the second conductive portions and the insulating regions of each conductive wire, wherein when the paper guide presses against the paper, the control-processing unit obtains a digital signal corresponding to the number of current passages formed between the first conductive portions and the corresponding conductive wire thereof so as to generate a paper-width value accordingly.

2. The paper-width detecting device according to claim 1, wherein the control-processing unit is disposed on the circuit board.

3. The paper-width detecting device according to claim 1, wherein the control-processing unit further comprises a database for providing a reference data corresponding to the value of the digital signal in order to generate the paper-width value.

4. The paper-width detecting device according to claim 1, wherein the digital signal is a set of binary codes and the number of the bits of the digital signal is less or equal to the number of the first conductive portions of the conductive element.

5. The paper-width detecting device according to claim 4, wherein the second conductive portions and the insulating regions of the conductive wires are arranged on the circuit board according to the coding rules of gray codes, such that only one bit of the digital signal is different for any two adjacent paper-width values.

6. The paper-width detecting device according to claim 1, wherein the second conductive portions are metals or metallic alloys.

7. The paper-width detecting device according to claim 1, wherein the circuit board is a printed circuit board (PCB).

8. The paper-width detecting device according to claim 1, wherein the control-processing unit is a microprocessor.

9. The paper-width detecting device according to claim 1, wherein the control-processing unit is an application specific integrated circuit (ASIC).

10. The paper-width detecting device according to claim 1, wherein the paper tray is disposed on an automatic document feeder (ADF).

* * * * *